United States Patent [19]

Pellegrino

[11] Patent Number: 4,480,795

[45] Date of Patent: Nov. 6, 1984

[54] METHOD FOR CLEANING WASTE DISPOSAL UNITS

[76] Inventor: Lawrence A. Pellegrino, 2136 Cherrystone Dr., San Jose, Calif. 95128

[21] Appl. No.: 364,982

[22] Filed: Apr. 2, 1982

[51] Int. Cl.[3] ..... B02C 23/00

[52] U.S. Cl. ..... 241/30; 241/46 B; 241/100.5; 241/167; 241/DIG. 30

[58] Field of Search ..... 241/DIG. 30, 30, 38, 241/166, 134, 46 A, 46 B, 46.08, 46.17, 47.17, 125, 257 G, 101.2, 102, 167, 100.5; 134/6, 7, 8, 25.2, 22.1, 94; 4/DIG. 4; 29/90 A; 15/95

[56] References Cited

U.S. PATENT DOCUMENTS

| | | | |
|---|---|---|---|
| 1,907,411 | 5/1933 | Timoney | 15/95 |
| 2,426,072 | 8/1947 | Wall et al. | 134/7 |
| 2,802,228 | 8/1957 | Federighi et al. | 15/95 |
| 4,337,901 | 6/1982 | Ogura | 241/46 B |

*Primary Examiner*—Howard N. Goldberg
*Assistant Examiner*—John Burtch
*Attorney, Agent, or Firm*—John J. Leavitt

[57] ABSTRACT

Presented is a method and means for use in cleaning the inside surfaces of a waste disposal unit. The device does not interfere with the grinding action of the disposal unit, nor is the device forming the subject matter of this invention subjected to the grinding action of the disposal unit while in use. Additionally, the device may include appropriately scented oils effective to make the inside of the disposal unit pleasantly aromatic.

15 Claims, 4 Drawing Figures

METHOD FOR CLEANING WASTE DISPOSAL UNITS

BACKGROUND OF THE INVENTION

1. Field of the Invention

This invention relates to cleaning methods and devices, and particularly to a method and means for abrading the inside surface of a waste disposal unit while the waste disposal unit is in operation.

2. Description of the Prior Art

It is believed that the prior art related to this invention may be found in the following Classes and subclasses:

Class 15, sub-classes 1, 95, 211
Class 134, sub-class 7
Class 4, sub-class Dig. 4
Class 241, sub-classes Dig. 30, 38
Class 29, sub-class 90A A search through the field of search indicated above has revealed the existence of U.S. Pat. Nos. 1,761,492; 1,907,411; 1,919,541 and 2,802,228. A review of these patents indicates that the method and means herein disclosed has not been taught by the prior art. Viewed broadly, these four patents teach the concept of entraining in a stream of water or other cleansing liquid a quantity of spherical rubber balls which with the water impact on the surface to be cleaned. In these patents it is the velocity of the stream of water in which the balls are entrained, or the velocity with which they are propelled by the stream of water, that renders the balls effective to perform a cleaning action.

In waste disposal units of the type where there may or may not be water flowing, and where there are rapidly oscillating members that effect a grinding action on waste materials, the problem is one of cleaning the interior of the waste disposal unit to eliminate from the inside surfaces thereof clinging particles of waste food materials that have been comminuted by the waste disposal unit, and which have not been flushed into the sanitary sewer system. The purpose of the waste disposal unit is to grind such waste materials into fine comminuted particles that can be entrained in water and carried through the conventional waste pipe to the sanitary sewer. Accordingly, it is one of the objects of the present invention to provide a method and means to clean the interior of a waste disposal unit by scouring the interior of the unit with the assistance of the rapidly oscillating grinding elements of the disposal unit.

Experiments with various types of waste diposal units have indicated that a waste disposal unit will grind up and dispose of almost any type of material deposited therein, with the exception of metallic items such as spoons, forks and knives. These will usually be bent into unusable form by the rapidly rotating and oscillating grinding elements of the waste disposal unit. In some cases these items are wedged within the unit in such a manner that rotation of the grinding units is prevented, thus causing an overload in the unit with the result that the unit will automatically trip off.

It has also been found that there are chemicals available that can be poured into a waste disposal unit and which are effective for a limited time to counter the unpleasant odors that usually emanate from waste disposal units. Other methods of cleaning the interior of waste disposal units are unsatisfactory and unpleasant and in some instances require the insertion of the hand into the unit to enable scouring of the side walls of the catch basin. This places the hand and fingers in close proximity to the grinding elements of the waste disposal unit, thus exposing the individual to serious injury if the switch is inadvertently turned on while a hand is within the waste disposal unit. Other items have been utilized, such as special brushes for reaching into the interior of the waste disposal unit to effect a cleansing action, but in general these have been found to be unsatisfactory in that they are ineffective and unpleasant to use. Accordingly, another object of the present invention is the provision of means which may be placed within the waste disposal unit and which will remain there for an indefinite and indeterminate length of time without being ground to bits by operation of the waste disposal unit, which will not be flushed through the unit, but which will nevertheless scour and clean the interior surfaces of the waste disposal unit.

It is a matter of common knowledge that the interiors of waste disposal units become coated with waste food products. Because the environment is usually warm and moist, food particles cling to the interior of the waste disposal unit for periods of time long enough for this material to decompose. Such decomposition of waste material clinging to the interior surfaces of the disposal unit creates a slime that emits a foul and unpleasant odor. Accordingly, another object of the present invention is to provide a method and means by which such waste material is prevented from clinging to the interior surfaces of the waste disposal unit and for simultaneously liberating within the interior of the waste disposal unit pleasantly scented oils which eliminate objectionable odors from the waste disposal unit.

Still another object of the invention is the provision of a method for cleaning the interior surfaces of the catch basin of a waste disposal unit which consists of causing a multiplicity of highly resilient bodies to impinge repeatedly against the interior surfaces of the catch basin to effect the scouring action thereof.

A still further object of the invention is the provision of means within the interior of a waste disposal unit which cooperates with the rapidly rotating and oscillating grinding blades or elements of the disposal unit to propel such means in trajectories and at velocities that a scouring action is effected on the interior surfaces of the catch basin while preventing the grinding action to be imposed on said means.

The invention possesses other objects and features of advantage, some of which, with the foregoing, will be apparent from the following description and the drawings. It is to be understood, however, that the invention is not limited to the embodiment illustrated and described since it may be embodied in various forms within the scope of the appended claims.

SUMMARY OF THE INVENTION

In terms of broad inclusion, the method and means for cleaning waste disposal units comprises, with respect to method, the abrading or scouring of the interior of the waste disposal unit by rapidly propelled highly resilient bodies that bounce back and forth innumerable times within the waste disposal unit, effectively cleaning an area at each impact. The highly resilient bodies are proportioned in size to preclude their passage through the waste disposal unit into the discharge line therefrom, and each possesses a degree of resilience so high that when they are struck by the rapidly rotating and oscillating grinding blades or elements of the disposal unit they immediately rebound away from such grinding blades and impact against the sides of the interior of the unit, thus simultaneously effecting a scouring action on the interior surfaces of the grinding unit, while precluding the highly resilient bodies being ground to bits by the grinding elements. Preferably, the configurations of the higly resilient bodies are other than spherical. Preferably, the configuration includes relatively abrupt edges and corners or points formed either by injection molding, extrusion or casting of the highly resilient bodies into specific shapes, or by cutting of such solid sections from other larger configurations such as a spherical member or rod.

DESCRIPTION OF THE PREFERRED EMBODIMENT

Figure 1:
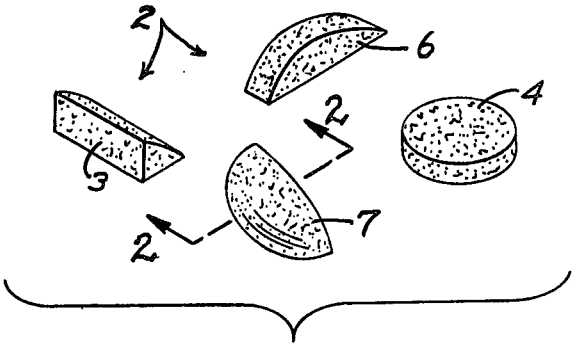
FIG. 1 shows the various shapes of the highly resilient bodies.
Figure 2:
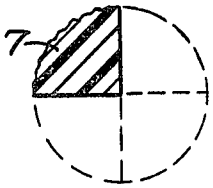
FIG. 2 shows how several highly resilient bodies are formed from one solid segment.
Figure 3:
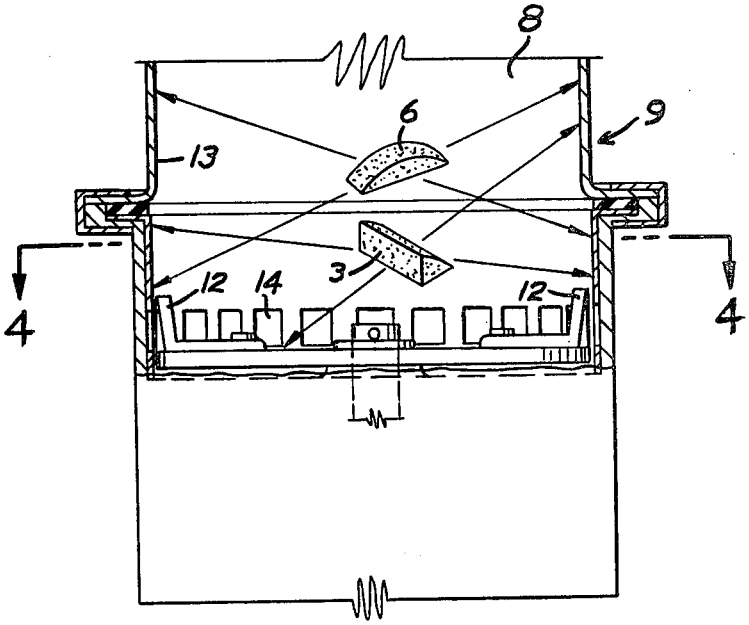
FIG. 3 shows a side cut-away view of the highly resilient bodies in a disposal.
Figure 4:
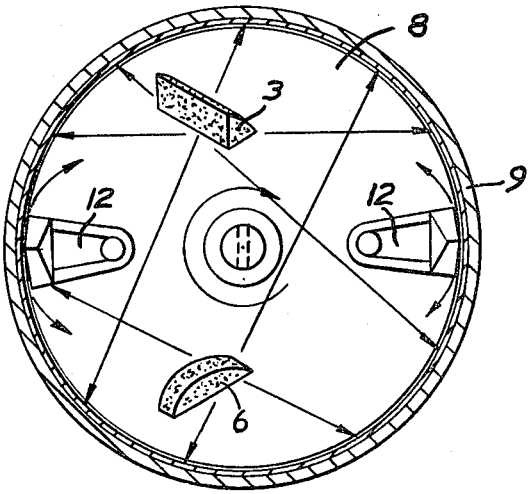
FIG. 4 is a top view of the highly resilient bodies in a disposal.

In terms of greater detail, the method and means for cleaning waste disposal units forming the subject matter of this invention comprises the formation and use of highly resilient bodies designated generally by the numeral 2 and illustrated in FIG. 1 as possessing different configurations such as the elongated body 3 having a triangular cross-section and sharp edges 3' and corners or points 3'', or the body 4 having a cylindrical cross-section and sharp edges 4', flat surfaces 4'' and cylindrical surfaces 4''', or the body 6 having the configuration of a solid segment of a cylinder having sharp edges 6' defining a cylindriform surface 6'' and a flat surface 6''', or a body 7 constituting a solid segment having the configuration of a quarter spherical solid body having sharp edges 7', spheroidal surface 7'' and two flat surfaces 7''' as illustrated in FIG. 2. Experiments have been conducted with each of these configurations, and modifications thereof, and these configurations, along with the modifications, have been found to produce satisfactory results.

The highly resilient bodies illustrated in FIG. 1, may be formed by injection molding, extrusion or by casting into the configurations illustrated, or they may be formed by cutting such solid sections from larger units. For instance, the body 7 illustrated in FIG. 1 may be injection molded or cast in a quarter sphere section, or it may be cut from a sphere FIG. 2 that is formed from appropriate material. In like manner, the body 4 may be molded or cast in such configuration, or it may be sliced from an elongated cylindrical body formed of indefinite length from appropriate material. Obviously, the method of manufacture of the separate configurations will depend upon the quantities of these members required to supply the demand.

Experiments have shown that, to be effective, the bodies illustrated in FIG. 1 must possess high resiliency. It has been found that bodies of the same configuration as illustrated but lacking resiliency, such as sponge rubber bodies or other types of soft and pliable materials lacking a high degree of resiliency, are ineffective and merely get ground up by the waste disposal unit.

It has been found that when the bodies illustrated in FIG. 1 are formed from cis-polybutadiene polymer which is a rubber-like product manufactured by B. F. Goodrich and sold under the trademark "Ameripol", or its equivalent, the bodies possess the high degree of resilience necessary to preclude being ground up by the grinding blades or elements of the waste disposal unit. Such highly resilient bodies, when deposited into the interior cavity or catch basin 8 of the waste disposal unit designated generally by the numeral 9, are struck by the rapidly rotating grinding elements 12 of the waste disposal unit 9 and, when so struck, are propelled rapidly in a direction away from the grinding elements, the bodies striking repeatedly against the interior surfaces 13 of the cavity 8, including the constricted throat portion.

Such repeated impingement of the highly resilient bodies against the interior surfaces of the catch basin may be effected with or without the passage of water through the system, and it may proceed with or without waste materials in the waste disposal unit. Most conventional waste disposal units are provided with a cavity or catch basin 8 having walls 13 which are provided with apertures 14 through which the ground up or comminuted waste material is ejected from the interior of the waste disposal unit. Experience has taught that highly resilient bodies as illustrated, when fabricated of a size larger than the apertures, do not pass through the apertures 14 and therefore are retained within the interior of the waste disposal unit for an indefinite time. For instance, in one experiment, four highly resilient bodies configured as in FIG. 1 dropped into the interior of a residential type waste disposal unit have lasted for as long as one year while still retaining their resiliency and effectiveness to scour the interior surfaces of the waste disposal unit.

In addition to effectively cleaning the interior surfaces 13 of the waste disposal unit 9, it is desirable that offensive odors that might emanate from the interior of the waste disposal unit be eliminated. I have found that such offensive odors may be eliminated by impregnating the highly resilient bodies illustrated in FIG. 1 with an aromatic oil such as, but not limited to, a lemon oil #10.169 as manufactured by Aromatiques Du Monde, Wayne, N.J. Experiments have shown that this oil is absorbed by the cis-polybutadiene polymer body over a period of time and is retained by the body and liberated slowly over time, thus imparting to the highly resilient bodies a pleasant aromatic odor that is slowly liberated within the interior cavity 8 of the waste disposal unit. It has been found that highly resilient bodies as illustrated in FIG. 1, when exposed to the lemon oil, "grow" to a size approximately twice their original untreated size. The highly resilient bodies will retain such enlarged size so long as they are retained in an air tight sealed container. It has also been found that upon exposure to air, over a period to time, the highly resilient bodies revert to their original size but retain substantial quantities of the aromatic oils such that these materials are liberated slowly over time, thus contributing to the wholesomeness of the interior of the catch basin or cavity 8 of the waste disposal unit.

In addition to the aromatic lemon oil described above, the material from which the highly resilient bodies illustrated in FIG. 1 are compounded includes a peroxide compound manufactured by the Hercules Company, and sold under the trademark DI-CUP 40 KE, the peroxide compound sold under this trademark constituting 40% dicumyl peroxide supported on Burgess KE clay. The peroxide compound functions as a curing agent for the cis-polybutadiene polymer during the vulcanizing step hereinafter to be described.

I have discovered that the amount of peroxide compound required to be added to the cis-polybutadiene polymer is quite small. For instance, I have found that 0.27% by weight of the peroxide compound added to the cis-polybutadiene polymer is about optimum. I have found that significantly less peroxide compound, say half or three-quarters of the amount specified, results in the final product disintegrating during use in a disposal unit. It is believed that too little peroxide compound affects the curing or vulcanizing process in some way to significantly reduce the resilience of the final product, thus effectively preventing the final product from rebounding fast enough when struck by the grinding elements of the diposal unit, resulting in their being ground to bits.

On the other hand, I have found that adding too much peroxide compound results in the final product being too hard, resulting in the generation of too much noise when in use, and resulting also in a degree of brittleness that causes the final product to break apart on impact by the grinding elements of the disposal unit. It appears that adding too much peroxide compound, say half again as much as specified above, lessens the molecular bonding strength of the material, causing it to disintigrate during use.

In addition to the peroxide compound described above, there is added to the cis-polybutadiene polymer approximately 6.9% by weight of a hydrophobic fumed silica material. I have found that a product sold under the trademark TULLANOX 500 by Tulco, Inc. produces satisfactory results when used in the proportion indicated. Again, use of significantly less of the hydrophobic fumed silica, say up to two percentage points less, results in an inferior product that possesses reduced tensile strength and which tends to break up during use. On the other hand, significantly more hydrophobic fumed silica than that specified, say two percentage points more, results in the final product being abrasively dry to the touch after the curing process, and generates many bubbles in the body of the product which have the effect of reducing the strength of the body.

To arrive at the optimum end product described above, I combine a quantity of the cis-polybutadiene polymer, which in its "raw" or uncured state is a sticky, homogenious mass, with the specified quantities, by weight of the peroxide compound and hydrophobic fumed silica. These ingredients are combined by kneading the mass until the peroxide compound and hydrophobic fumed silica are distributed uniformly throughout the mass of cis-polybutadiene polymer.

After thorough kneading to uniformly distribute the ingredients throughout the mass, small portions of the material are detached from the mass and, in one aspect, for instance to produce the cylindrical wafer-like body 4, the detached portion is rolled into an elongated rod having a selected diameter, say one-half inch, and the elongated rod is wrapped in a heat-resistant material such as foil or cellophane. After wrapping with foil or cellophane, the elongated rod is sliced transversely to produce shorter rods of about 1" to 2" in length. These shorter rods are then loaded separately into complementary cavities of a simple molding device provided with a cover plate to confine the material in the cavities during curing.

After the mold is loaded and sealed by the cover plate, the entire mold, loaded with material, is placed in an appropriate preheated oven heated to a temperature of about 400° C. for an interval of about 19 to 22 minutes. This curing operation rapidly converts the material contained in the mold to a high density, highly resilient, tough, cohesive mass formed into a cylindrical slug or pellet equal in length and configuration to the cavity in which it is formed. Thereafter, the foil or cellophane wrapping is removed and the elongated cylindrical body is sliced into three or four separate pellets or wafers 4 as seen in FIG. 1.

It should be understood that while I have described a curing process for the material which utilizes high heat and a relatively short time, the curing may proceed at room temperature over a longer period of time.

Following the curing and slicing steps described above, the cured pellets or wafers are placed in a container capable of being sealed air-tight and the oil of lemon discussed above is added to the container. Sufficient oil of lemon, or other suitable aromatic oil, is added to thoroughly wet the pellets. The effect on the pellets of exposure to the oil of lemon, is that the pellets absorb the oil of lemon. As the oil of lemon is absorbed, the pellets grow progressively over time, about four hours, until they become approximately twice their normal size. The pellets are then removed from the sealed container and either air-dried over time, or placed in a sealed container for storage. When stored in a sealed container prior to air-drying, it has been found that the pellets will retain their expanded size so long as they are retained in the sealed container. Upon being removed, the essence of oil of lemon starts an evaporation process, and the pellet starts to shrink to its original size, which it achieves in about seven to ten days.

It is interesting to note that even in their expanded condtion as a result of absorption of oil of lemon, the pellets retain their high degree of resilience. Tests have indicated that such expanded pellets may be placed immediately in the disposal unit from the sealed container and will function in the manner intended. While being used in the disposal unit, over a period of seven to ten days, the pellets will shrink to their original size. However, it is found that the pellets never seem to lose the aromatic quality achieved by absorption of the oil of lemon.

While I have described a preferred method of forming the end product comprising the highly resilient bodies, other methods may obviously be used without departing from the spirit of the invention. For instance, the formed bodies of "raw" or uncured material may be removed from the mold prior to curing, the curing being effected in the same manner, i.e., oven-curing, or cured over time at room temperature.

In like manner, the end product may be in the form of air-dried bodies saturated with oil of lemon but having no discernible oil of lemon on the exterior surfaces, thus permitting the cured bodies to be handled with the hands without fear of smearing the hands with oil of lemon. On the other hand, it may be more expeditious to package and sell the aromatic and highly resilient bodies in sealed containers while they are still in expanded form. In either event, the highly resilient bodies will perform the function intended.

Having thus described the invention, what is believed to be new and novel and sought to be protected by letters patent of the United States is as follows:

I claim:

1. The method of cleaning the interior surface of a waste disposal unit equipped with a catch basin forming an interior cavity and having grinding elements disposed within the cavity, comprising the steps of:

(a) depositing within the interior cavity of the waste disposal unit at least one highly resilient body, said body having a degree of resilience sufficiently high to cause said body to rebound continuously without damage from moving grinding elements of the disposal unit; and (b) agitating said at least one highly resilient body while said body is confined within the waste disposal unit cavity, whereby said highly resilient body is propelled in trajectories and at velocities which cause said body repeatedly to impact against and rebound from the interior surfaces thereof to effect a scouring action thereon.

2. The method according to claim 1, in which the agitation of said at least one highly resilient body is effected by energizing the waste disposal unit to cause the grinding elements thereof to impact against the highly resilient bodies.

3. The method according to claim 2, in which water is admitted to the interior cavity of the waste disposal unit during the agitation step.

4. The method according to claim 2, in which the essence of an aromatic oil is released within the interior of the waste disposal unit during such agitation.

5. The method according to claim 4, in which said essence of aromatic oil is carried and released by said highly resilient body and is caused to adhere to the interior cavity surfaces of the waste disposal unit upon impact of the highly resilient bodies therewith.

6. In combination, a waste disposal unit including a catch basin forming a cavity within which waste materials may be deposited and having grinding elements therewithin adapted to be rotated and oscillated rapidly to effect a grinding action on waste materials deposited in the cavity, and a high density, highly resilient, tough, cohesive pellet located within the catch basin cavity of the waste disposal unit, the degree of resilience of said pellet being sufficient to cause it to repeatedly and continuously rebound from said grinding elements without damage when struck thereby to prevent said highly resilient body being ground up by said grinding elements.

7. The combination according to claim 6, in which a plurality of said highly resilient bodies are disposed within the catch basin of said waste disposal unit.

8. The combination according to claim 6, in which said catch basin is provided with apertures, and said highly resilient bodies are proportioned in size larger than said apertures in said catch basin through which comminuted waste materials normally are flushed to the sanitary sewer system.

9. The combination according to claim 6, in which said highly resilient body is irregular in its configuration, including at least one sharp edge.

10. The combination according to claim 6, in which said highly resilient body is compounded by the admixture of cis-polybutadiene polymer, a predetermined percentage by weight of a peroxide compound, and a predetermined percentage by weight of a hydrophobic fumed silica material.

11. The combination according to claim 10, in which said peroxide compound comprises approximately 0.27% by weight of the cis-polybutadiene polymer.

12. The combination according to claim 10, in which said hydrophobic fumed silica comprises approximately 6.9% by weight of the cis-polybutadiene polymer.

13. The combination according to claim 10, in which said peroxide compound comprises 40% dicumyl peroxide supported on Burgess KE clay.

14. The combination according to claim 10, in which said hydrophobic fumed silica is in fine powder form.

15. The combination according to claim 6, in which said highly resilient body is impregnated with an aromatic oil.

* * * * *